United States Patent [19]

Olivier

[11] 4,004,722

[45] Jan. 25, 1977

[54] HANDLE DEVICE

[75] Inventor: Lynn Olivier, Brooklyn Heights, N.Y.

[73] Assignee: Lawrence Peska Associates, Inc., New York, N.Y. ; a part interest

[22] Filed: Aug. 20, 1975

[21] Appl. No.: 606,204

[52] U.S. Cl. ..... 224/45 P; 150/12

[51] Int. Cl.[2] ..... A45C 13/26

[58] Field of Search ..... 224/45 P, 45 R; 229/52 A, 52 AC, 54 R, 54 C; 190/57; 150/12; 220/85 D

[56] References Cited

UNITED STATES PATENTS 3,459,362 8/1969 Giachi ..... 229/54 R

FOREIGN PATENTS OR APPLICATIONS 218,419 4/1961 Austria ..... 229/54 R 911,948 12/1962 United Kingdom ..... 224/45 P

*Primary Examiner*—Robert J. Spar

*Assistant Examiner*—Donald W. Underwood

[57] ABSTRACT

This disclosure pertains to a reusable handle to be attached to twine or rope bindings of packages, or to the flexible straps of shopping bags. The handle has a slit allowing the rope or twine to pass into a hollow tubular section parallel to the handle. The user grasps the handle which is substantially thicker and smoother than the binding material, thus providing a comfortable grasping surface, preventing abrasion of the skin.

1 Claim, 4 Drawing Figures

HANDLE DEVICE

BACKGROUND OF THE INVENTION

1. The Field of the Invention

This invention relates to accessory devices used to provide convenience in carrying articles which are bound by narrow or sharp flexible materials.

2. Description of the Prior Art

The most common appliance available is comprised of a wooden or plastic hollow tube through which a metal wire passes. The free ends of the wire are bent at right angles to the axis of the tube and terminate in a double bight. In use, the bight portions of the wire are caught by the rope or twine surrounding the package. The user grasps the tube within the palm of the hand and thus avoids the cutting effect which would be experienced if the user were to grasp the rope or twine directly. The heavier the package the more discomfort the user experiences. The disadvantages of this type of product is the difficulty in fastening the bights of the wire onto the rope or twine and the discomfort experienced by the small diameter tubing employed.

SUMMARY OF THE INVENTION

The instant invention is comprised of a semi-rigid material such as plastic or rubber formed into a hollow tube having a slit running longitudinally the entire length thereof. A rigid handle portion runs parallel to the axis of the tubing and has a substantial diameter. In applying the device to a bound package, the rope or twine is passed through the slit which is located near the points at which the handle portion attachs to the hollow portion. The user simply grasps the handle in such a way that the tubing portion is rotated so that the slit lies in a plane parallel to the surface of the package. Lateral motion of the handle device permits the entry of the rope or twine, encircling the package, into the slit, confining the rope or twine within the hollow tubing portion. In use, the handle portion is at right angles to the surface of the package thus preventing the rope or twine from emerging from the slit which is now located furthestmost from the surface of the package. The handle attachment can be removed, for reuse, by rotating the entire device around the axis of the rope or twine until the handle portion touches the surface of the package. Reverse lateral motion of the handle permits the rope or twine to pass through the slit thus detaching the device from the package bindings.

A primary object of the instant invention is to provide an inexpensive device providing a comfortable way in which a rope-bound package may be carried.

Another object is to provide a handle attachment which easily fastens to the binding rope or twine.

Still another object is to provide a handle which has substantial thickness in the hand grasping area.

A further object is to provide a handle attachment which can be used repeatedly.

Another object is to provide a handle attachment which is easily removed from the binding material.

Still another object is to provide a handle attachment which does not permanently deform when attaching to the rope or twine or when being utilized in carrying heavy packages.

A further object is to provide a surface for grasping which has undulations accommodating the fingers.

Another object is to provide a grasping surface which is undulated so that the fingers of the user will not slip when the user perspires.

Still another object is to provide a handle attachment which can be grasped with two hands.

These objects, as well as other objects, of this invention will become readily apparent after reading the following description of the accompanying drawings.

DESCRIPTION OF THE PREFERRED EMBODIMENT

The structure and method of fabrication of the present invention is applicable to a semi-rigid material formed into a handle devised to attach to rope, twine, or bands which encircle a package facilitating a comfortable gripping surface. No permanent deformation of the handle is experienced despite repeated attachments and detachments or when carrying a heavy package. The device could be fabricated from plastic by conventional molding techniques such that the cross-section of the rope encircling portion is thinner at the area nearest the slit as compared to the remainder of the cross-section. Large diameter rope or twine sections can be forced through the slit upon moderate flexion of the thinner tongue-like wall adjacent the slit. The hand grasping portion of the handle is relatively more rigid than the tongue adjacent the slit and is provided with undulations on the surface of the handle. These undulations may continue around the entire circumference of the handle or be confined substantially to the undermost surface.

Figure 1:
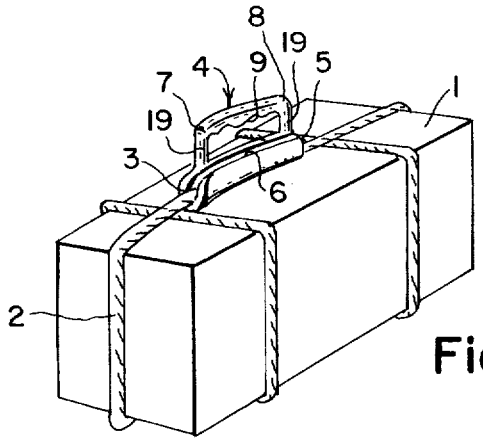
FIG. 1 is a perspective view of a rope-bound package to which a handle device is attached.

Now referring to the Figures, and more particularly to the embodiment illustrated in FIG. 1 illustrating a package 1 which is bound by a flexible material 2 such as rope, twine, tape, or straps. The handle device 4 is illustrated encircling the package binding at points 3 and 5.

Figure 2:
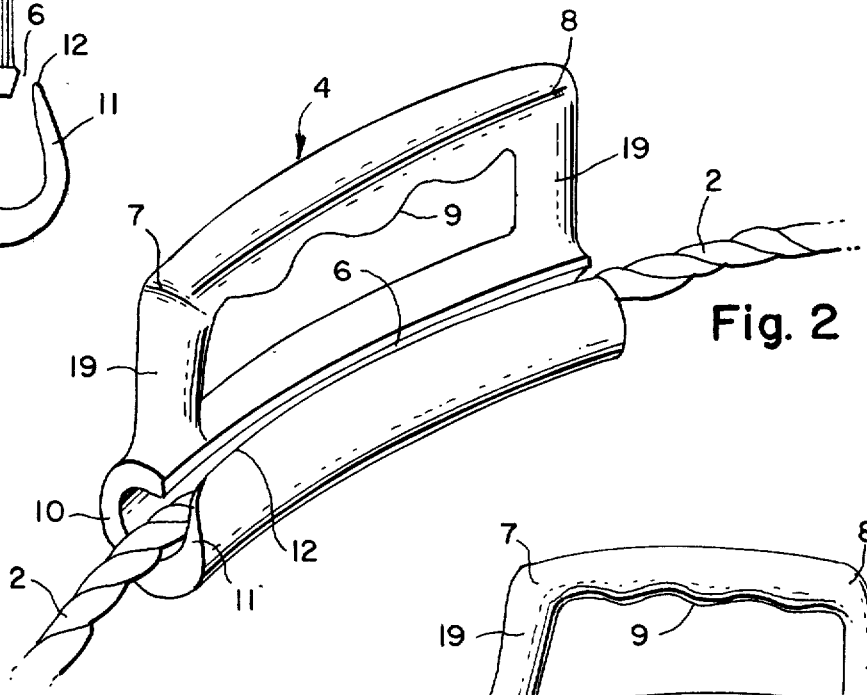
FIG. 2 is a perspective view of a handle device encircling a segment of rope.

FIG. 2 shows the handle 4 attached to a section of rope 2. A slit 6 runs the entire length of the handle and is parallel to the axis of the hole formed to capture the rope. The hand grasping portion of the handle is between points 7 and 8 of that part of the handle which is parallel to the rope. Undulations 9 are formed to facilitate a convenient comfortable grasping area.

Figure 3:
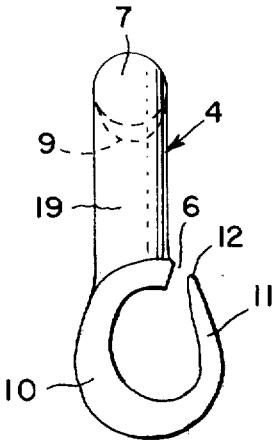
FIG. 3 is a side elevation view of a handle device.

FIG. 3 is a side elevation view of the handle attachment depicted in FIG. 2 with the rope segment deleted. The hand grasping length of the handle confined between point 7, and point 8, not shown, is supported by end vertical joining member 19. The hollow tubular portion of the handle has a cross-sectional thickness, illustrated at point 10, which is substantially uniform around the entire circumference. The cross-section starts to decrease gradually at point 11 until the thickness terminates in a blunt tongue 12. Slit 13, utilized to provide access for the rope, may be widened by flexure of the tongue.

Figure 4:
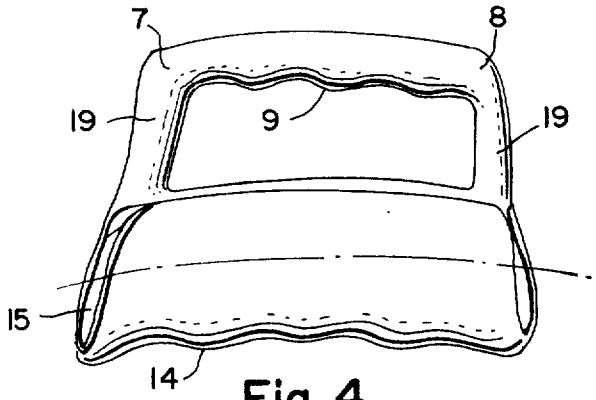
FIG. 4 is a front elevation view of a modified version of a handle attachment.

FIG. 4 depicts a modified version of a handle attachment. The lowermost surface of the handle is adapted with additional undulations 14. This provides an increased additional grasping length which may be used in conjunction with a heavy package. The cavity 15 is illustrated as having a nearly elliptical cross-section rather than the essentially circular cross-sectinal opening as shown in FIG. 2. This elliptical shape permits a plurality of rope or twine lengths to be captured within. Undulations 14 perform the same function as the finger undulations 9. This embodiment of the invention provides a handle attachment which can be used with two bands.

One of the advantages is an inexpensive device providing a comfortable way in which a rope-bound package may be carried.

A further advantage is a handle attachment which easily fastens to the binding rope or twine.

Another advantage is a handle which has substantial thickness in the hand grasping area.

Still another advantage is a handle attachment which can be used repeatedly.

A further advantage is a handle attachment which is easily removed from the binding material.

Another advantage is a handle attachment which does not permanently deform when attaching to the rope or twine or when being utilized in carrying heavy packages.

Still another advantage is at least one surface for grasping which has undulations accommodating the fingers.

A further advantage is a grasping surface which is undulated so that the fingers of the user will not slip when the user perspires.

Another advantage is a handle attachment which can be grasped with two hands.

Thus, there is disclosed in the above description and in the drawings, embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

I claim:

1. A handle device comprising a longitudinal hollow tubular section having a rigid hand grasping portion, said hand grasping portion having finger gripping undulations formed in the surface thereof, said hand grasping portion parallel to said longitudinal hollow tubular section and spaced radially outwardly therefrom, said hand grasping portion joined to said longitudinal hollow tubular section by two rigid joining members formed at the free ends of said longitudinal hollow tubular section, said joining members substantially perpendicular to the longitudinal axis of said hollow tubular section and said hand grasping portion forming a void whose length is less than the length of said longitudinal hollow tubular section, a continuous slit passing through the wall of said longitudinal hollow tubular section, said slit parallel to the longitudinal axis of said hollow tubular section, said slit extending the entire length of said longitudinal hollow tubular section, said joining members immediately adjacent first edge of said slit, second edge of said slit substantially thinner than said first edge, finger accommodating undulations on the outer surface of said longitudinal hollow tubular section.

* * * * *